US006095721A

United States Patent [19]

Von Benzon

[11] Patent Number: 6,095,721

[45] Date of Patent: Aug. 1, 2000

[54] METHOD AND DEVICE FOR BURYING A CONDUIT UNDER WATER

[75] Inventor: Ernst Von Benzon, Frederikssund, Denmark

[73] Assignee: Geoteknisk Institut, Lyngby, Denmark

[21] Appl. No.: 08/983,395

[22] PCT Filed: Jul. 18, 1996

[86] PCT No.: PCT/DK96/00327

§ 371 Date: Jul. 20, 1998

§ 102(e) Date: Jul. 20, 1998

[87] PCT Pub. No.: WO97/04181

PCT Pub. Date: Feb. 6, 1997

[30] Foreign Application Priority Data

Jul. 20, 1995 [DK] Denmark ..... 0851/95

[51] Int. Cl.[7] ..... E02F 5/10

[52] U.S. Cl. ..... 405/180; 405/163; 405/174; 405/179; 37/142.5; 37/344; 37/367

[58] Field of Search ..... 405/158, 159, 405/160, 161, 162, 163, 164, 165, 174, 175, 179, 180, 182; 37/142.5, 905, 367, 380, 344, 347

[56] References Cited

U.S. PATENT DOCUMENTS

| | | | |
|---|---|---|---|
| 3,333,432 | 8/1967 | Hale et al. | 405/164 |
| 3,338,060 | 8/1967 | Harmstorf | 405/163 |
| 3,434,297 | 3/1969 | Gretter et al. | 405/160 |
| 3,504,504 | 4/1970 | Elliott | 405/163 |
| 3,505,826 | 4/1970 | Harmstorf . | |
| 3,576,111 | 4/1971 | Henry, Jr. | 405/163 |
| 3,638,439 | 2/1972 | Niederer . | |
| 3,874,182 | 4/1975 | Potter et al. | 405/179 |
| 4,091,629 | 5/1978 | Gunn et al. | 405/165 |
| 4,114,390 | 9/1978 | Van Steveninck et al. . | |
| 4,498,813 | 2/1985 | Nelson et al. | 405/182 |
| 4,787,777 | 11/1988 | Harmstorf | 405/163 |
| 4,812,079 | 3/1989 | Johnson et al. . | |
| 4,830,537 | 5/1989 | Munro et al. | 405/179 |
| 4,892,443 | 1/1990 | Kunze et al. . | |
| 4,896,997 | 1/1990 | Gaylin | 405/174 X |
| 5,088,857 | 2/1992 | Harmstorf | 405/159 |
| 5,433,277 | 7/1995 | Davison | 405/182 |
| 5,765,966 | 6/1998 | White et al. | 405/174 |

FOREIGN PATENT DOCUMENTS

| | | | |
|---|---|---|---|
| 0 062 111 | 10/1982 | European Pat. Off. . | |
| 0 472 314 | 2/1992 | European Pat. Off. . | |
| 1 484 388 | 6/1971 | Germany . | |
| 29 37 406 | 2/1982 | Germany . | |
| 29 53 900 | 10/1984 | Germany . | |
| 38 00 417 | 7/1989 | Germany . | |
| 1244400 | 9/1971 | United Kingdom | 405/174 |
| WO 81/01433 | 5/1981 | WIPO . | |
| WO 93/05242 | 3/1993 | WIPO . | |

*Primary Examiner*—David Bagnell
*Assistant Examiner*—Jong-Suk Lee
*Attorney, Agent, or Firm*—Merchant & Gould P.C.

[57] ABSTRACT

A method for the penetration of a body (8), having a leading edge (21) and an inclined ground contacting surface (C, D, E) extending upwardly therefrom, into a porous ground material, the pores of the ground material being at least partially filled with water. The method comprises applying a driving force to the penetrating body in the direction of penetration, and discharging from the penetrating body (8) at least one flow of high-pressure gas to the inclined surface so as to facilitate the penetration of the body. Moreover, a penetrating body (8) and a plough assembly both of which can be used in the method. The method and equipment may e.g. be used for embedding drain tubes, pipes, cables or similar objects into a ground material also at a relatively great depth larger than 100 cm. Moreover, the embedding can be performed by employing a relatively high speed and can be performed at a relatively low energy consumption.

20 Claims, 4 Drawing Sheets

METHOD AND DEVICE FOR BURYING A CONDUIT UNDER WATER

FIELD OF THE INVENTION

The present invention relates to a method for the penetration of a body into a porous ground material, it furthermore relates to a penetrating body and a plough assembly both of which can be used in the method.

BACKGROUND OF THE INVENTION

The embedding of drain tubes, cables, or pipes and the like in the ground normally comprises the use of a penetrating body such as a plough having a plough blade or another member for the cutting of or penetration into a ground material so as to form a furrow or void for receiving the drain tubes, cables or pipes.

The drain tubes, cables or pipes which are to be laid down and ploughed under are typically continuously embedded into the furrow or void from a reel via a guide member which is normally mounted on the rear end of a tractor or other driving force pulling a plough.

Irrespective of whether the ground material is soft or hard, it is important that the penetrating bodies, such as cable ploughs, are able to form a furrow or void in which it is possible to lay the drain tubes, cables or pipes, as well as being able to function in many types of terrains or ground surfaces and at various depths.

Ploughs designed for embedding cables into the ground material are known from e.g. U.S. Pat. No. 4,892,443 and DE-B-1 484 388.

U.S. Pat. No. 4,892,443 describes a cable plough with a design which enables automatically setting suitable laying depths for different terrains or ground surfaces which may alternately include extremely soft and extremely hard formations so that the driving force of the plough simultaneously varies automatically in accordance with the ground conditions. The laying depth amounts to approximately 80 cm. It is stated that smaller penetration depths are adequate.

In order to obtain a more efficient embedding, ploughs including means for jetting a liquid are known from e.g. U.S. Pat. No. 3,638,439, U.S. Pat. No. 4,114,390, U.S. Pat. No. 4,812,079, U.S. Pat. No. 3,505,826, DE 29 37 406 C1 and DE 29 53 900 C2. The means for jetting of water are stated to be employed in order to obtain a more efficient embedding since the jetting of water is stated to be able to liquefy the ground material to be penetrated and thus facilitating the embedding.

U.S. Pat. No. 3,638,439, U.S. Pat. No. 4,114,390 and U.S. Pat. No. 4,812,079 describe an apparatus for the embedding of cablelike members under water.

U.S. Pat. No. 3,638,439 discloses an apparatus for embedding a cable-like member under water, comprising a water bed contacting support assembly, an entrance guide having a longitudinal axis, a depressor extending generally along a continuation of said axis rearward of said entrance guide, a jet assembly extending beneath said depressor and, connected to said jet assembly, a source of fluid under pressure for creating a jet flow to temporarily liquefy water bed soil in the path of said member without substantial permanent soil displacement, said flow rate being at least 300 gallons/minute and said pressure being no more than 300 p.s.i. The fluid utilized is water.

U.S. Pat. No. 4,114,390 discloses an apparatus for burying a conduit in the earth at the bottom of a body of water, comprising a frame adapted to be displaced along the conduit, and two sets of fluidization nozzles, one along the bottom of the frame and connected to means for supplying fluid at low velocity and low pressure thereto, and another one along the front of the frame, movable relative to the frame in a direction other than the direction of displacement of the frame and connected to means for supplying fluid at high velocity and high pressure thereto, the fluid utilized according to the patent specification being water.

U.S. Pat. No. 4,812,079 discloses an embedding apparatus for optionally cutting through different densities of soil and rock in order to embed cable in a water bed. The apparatus comprises a low pressure jet assembly for cutting into soil, a rock cutting assembly with teeth for cutting into soft rock, a rock-embedment depressor with a rotary saw blade assembly for cutting into relatively harder rock, and a depth sensor device. The fluid utilized is again, as in the case of the two above-mentioned documents, water.

U.S. Pat. No. 3,505,826 describes a method and an apparatus for the embedding of a pipeline into the ground of a water bed. The apparatus, a train of towed flushing and sucking elements, comprises means for spraying water jets into ground to be broken up hydraulically below the pipeline and suction tubes to remove the ground sludge from below the pipeline to places beside the pipeline route.

DE 29 37 406 C1 and DE 29 53 900 C2 both describe a mole plough for laying cables or pipes in marshy or water logged ground. The plough has a leading rotary saw or straight blade which is provided with jet pipes vertically mounted behind the cutting edge.

SUMMARY OF THE INVENTION

The methods for embedding e.g. cables employing a penetrating body such as a plough of one of the types described above are not normally suitable for penetrating the ground or a ground material in depths below about 100 cm. The depth at which drain tubes, cables or pipes can be embedded by using such penetrating bodies is typically limited by the driving or pulling force available and/or the relative strength of the penetrating body.

The penetration of a body into the ground material in relatively large depths of about 100 cm is normally a very costly and tedious operation since the resistance forced upon the body by the ground material results in a relatively slow penetration speed, and normally, it is not feasible to increase the driving force and/or increase the relative strength of the body.

In cases where drain tubes, cables or pipes are embedded in the ground above, but close to, at, or below ground water level, the pores of the ground material are at least partially filled with water, such conditions further obstruct the penetration movement of the penetrating body. The driving forces applied to the body for the operation in such an environment often only allow a very slow rate of penetration and hence, under such conditions embedding of drain pipes, cables or tubes normally becomes infeasible or even impossible.

Furthermore, the present inventor has found that in order to be able to achieve a satisfactory penetrating speed, relatively large quantities of water and/or a relatively high pressure must be applied if a significant liquefaction of the ground material is to be obtained.

The present inventor has estimated that to a depth of 2 m and at a velocity of approx. 4 m/min in a costal area wherein the ground material is at least partially filled with water the penetration of a plough will require jetting of at least about 450 $m^3$ water/h at a pressure of about 7 bar or of about 80

$m^3$ water/h at a pressure of about 20 bar which will require considerable power supply. Thus, employment of water jets is very energy consuming and therefore generally not regarded as economically feasible.

Moreover, loosening and subsequent removal of large stones/rocks in the ground material has been found to be difficult when jetting water.

In addition, backflow of water to the furrow which is to receive a drain tube may counteract a proper filling up of the furrow with ground material.

The problems outlined above are significantly reduced or even solved by the method according to the present invention by means of which penetration may be facilitated, whereby penetration depths and penetration speeds of a penetrating body can be increased.

Thus, the present invention provides a method for the penetration of a body, having a leading edge and an inclined ground contacting surface extending upwardly therefrom, into a porous ground material, the pores of the ground material being at least partially filled with water, said method comprising applying a driving force to said penetrating body in the direction of penetration, and being characterized in that it further comprises discharging from said penetrating body at least one flow of high-pressure gas to said inclined surface so as to facilitate the penetration of the body, the gas having a pressure that exceeds the pressure of the surrounding environment.

The method according to the invention may e.g. be used for embedding drain tubes, pipes, cables or similar objects into a body of ground at any depth i.e. also at a relatively great depth larger than 100 cm. Moreover, the embedding can be performed by use of a relatively high speed and at a relatively low energy consumption.

In general, the method according to the invention facilitates penetration of a body into ground material, whereby a relatively high speed of penetration as well as penetration in large depths, even close to or below the ground water level, is rendered possible. Consequently, the costs of performing such operations may be significantly reduced.

The inclined ground contacting surface is continuous, but may be divided into one or more linear or curved sections each or at least one thereof extending upwardly from the leading edge. The linear sections are also denoted cutting planes. The linear section(s) of inclined ground contacting surfaces is/are formed in manner suitable for the intended application. The number of linear sections may vary according to the properties of the ground material and is normally in a range of 1 to 6, such as 1, 2, 3, 4, 5 or 6.

The angles between the lower plane extending from the leading edge and each of the linear sections may also vary depending on the properties of the ground material and the intended flow direction of discharged gas. The angles may be in the interval between 0–180°, such as in the interval of from 0 to 90°, such as e.g. 20, 30, 40, 45, 50, 55, 60, 65, 70, 75, 80°.

The length of each of the linear sections may also vary depending on the intended application and the number of linear sections. If the penetrating body is a plough body the dimensions of the linear sections are in the range of what is normally accepted. The same applies for other penetrating bodies. The total length of the inclined ground contacting surface is normally from between about 50 mm to about 1000 mm.

The inclined ground contacting surface or parts thereof provides a pre-cutting member which enables a suitable breaking up of the ground material just in front of the outlet of the discharged flow of gas e.g. via a recess such as a groove or a channel found in the inclined ground contacting surface (cf. below). Furthermore, the inclined ground contacting surface may improve the wear stability of the penetrating body.

Moreover, the inclination of the inclined ground contacting surface provides possibilities for variation of the area of the recess(es) according to the properties of the ground material so as to adjust the amount of and flow of gas discharged enabling the desired penetration. For example, it has been found that penetration of fine particulate ground material is well performed by use of an inclined ground contacting surface having three linear sections as the ones described in FIG. 3.

The inclined ground contacting surface will furthermore enable a protection of the outlet(s) of gas at e.g. a nozzle or the like from blockage of soil, sand or other particles in the ground material.

The penetrating body used in a method according to the present invention in the present invention may comprise a plough body having a cutting and/or leading edge such as a plough blade for the cutting of, or penetration into, a ground material. Such plough bodies are normally used for embedding drain tubes, cables or pipes.

The terms "ground" and "ground material" in the present context are used according to the definitions outlined in Eurocode 7: Geotechnical design—Part 1: General rules (European prestandard ENV 1997-1 of Oct. 1, 1994) and comprise also soil, sand, peat, clay, rock, seafloor and/or seabed, any ground fill such as fills made at dump sites, or the like, or combinations thereof.

The high-pressure gas is normally compressed or pressurized air, generated by any type of air compressing device which is able to deliver the necessary amount at the pressure required.

Discharge of gas is an important feature in connection with the present invention. The gas may be high-pressure gas, compressed gas or pressurized gas, and the gas may be atmospheric air or the like.

Without being bound to any specific theory, it is considered likely that when the flow of high-pressure gas is discharged from the penetrating body hits the surrounding ground at least partially filled with water, it causes the ground material to break up and lifts the ground material around the ground contacting surface of the penetrating body.

It is believed that the high-pressure gas discharged expands concurrently with the temporary displacement of the ground material caused by the penetration of the body.

The high-pressure gas discharged is believed to establish a domain in the ground material. The domain is likely to have a density substantially lower than the ground material not exposed to the discharge of high-pressure gas. The domain of ground material thus having a lower density will have properties which are more or less similar to those of quick sand, and the discharge of high-pressure gas will cause a virtual explosion-like erosion of the ground material to take place around the penetrating body resulting in a easier penetration of the ground material.

The ground material exposed to the discharge of high-pressure gas is not washed away from the ground contacting surface, but is simply, due to the low density, lifted upwards and away from the penetrating body and the ground material will only form a sediment again when the penetrating body has been driven through the ground material. The establishment of the domain of low density material around the penetrating body may also reduce the wear of the penetrating body, and it has been found that even ground material comprising larger stones and rocks may be penetrated since the boiling up of the ground material will lift the ground material including the stones and rocks which may even be deposited on the top surface of the ground material.

The high-pressure gas is preferably supplied to at least one recess found in the inclined ground contacting surface of the penetrating body.

Preferably, at least part of the high-pressure gas is discharged at a location of the ground contacting surface spaced from the leading edge of the body such that the cross-sectional area of the body at said location is substantially larger than the cross-sectional area closely adjacent to the leading edge.

The driving force applied may be any suitable driving force such as obtained by a tractor or trenching machine or the like; or it may a be a percussive and/or a oscillating force.

The effect of the discharge of high-pressure gas may be amplified if such driving forces are used.

When a percussive force is applied, the body is caused to change between a stressed condition, in which the penetrating body is driven through the ground by the momentum delivered by the percussive force, and an unstressed condition, in which the penetrating body is substantially stationary and not exposed to forces imposed by the percussion.

The driving force may also be an oscillating force causing the penetrating body to vibrate during the penetration into the ground. The oscillating force may either be applied continuously or in a percussive manner as a series of controlled and predetermined, varying pulses.

The flow of high-pressure gas is normally discharged at a pressure (determined as overpressure in relation to the pressure of the surrounding environment) in the range of about 1 to about 100 bar, about 1 to about 50, about 5 to about 50 bar, about 1 to about 10 bar, about 5 to 10 bar or such as about 32 bar or in the range of about 7 to about 20 bar.

Even if the pressure ranges indicated above are considered suitable and advantageous in most situations, there may be situations where a sub-range of pressures, such as about 9 bar to about 15 bar is especially suitable.

The generator of high-pressure gas is typically able to discharge the flow of the high-pressure gas to the outlets or nozzles of the penetrating body at a supply rate of high-pressure gas in a range of about 1 to about 500 $m^3$/min such as in the range of about 5 to about 100 $m^3$/min.

The high-pressure gas may be discharged as varying pulses and in a controlled or pre-determined sequence of varying pulses. An "air-hammer" like effect in the domain of penetration may thus be created and this effect may further intensify the impact of the discharge of the flow of high-pressure gas and, consequently, it may be possible to increase the speed or depth of penetration of a body in a ground material.

Preferably, the pressure of the high-pressure gas is varying and/or pulsating.

When e.g. a ground material is especially hard, such as in the top layer of a seafloor, the flow rate of the high-pressure gas may advantageously be a flow rate which is not constant but varied.

It is possible to increase the effect of the blast of the gas discharged from the body penetrating the ground by varying the pressure of the high-pressure gas. This may be performed in a controlled or pre-determined manner, such as by varying the pressure from about 2 bar to about 10 bar and back to 2 bar over a period of e.g. 0.1 second and, consequently, it is possible to achieve an increase of the efficiency of penetration into a body of ground such as a clayey ground material.

The discharge of gas may also be used for controlling the direction of penetration. As an example, when the penetrating body comprises more than one nozzle outlet for the discharge of the high-pressure gas, the flow rate and the pressure of the flow of high-pressure gas may advantageously be controlled to shift from one nozzle outlet to another. The shift of the flow from nozzle to nozzle may be performed continuously and in a predetermined and controllable manner. This feature further allows control over the direction of the penetrating body when driving it through the ground.

It should be understood that the various manners of applying the flow of the high-pressure gas as indicated above could be combined with any technique for applying the driving force to the penetrating body.

The present invention further provides a body for penetrating into a porous ground material and comprising a leading edge and an inclined ground contacting surface extending upwardly therefrom, means for receiving a driving force so as to cause the penetration, said body being characterized in that it further comprises means for supplying a pressurized gas to a cavity defined within the body, and gas discharging means communicating with the cavity for discharging pressurized gas to at least one opening defined in the ground contacting surface and into the ground material surrounding the body so as to facilitate the penetration.

The gas discharging means may suitably discharge the gas over a substantial part of an outer ground contacting surface of the body.

It is preferred that the gas distributing means comprise at least one recess, such as channels or grooves defined in the outer, ground contacting surface of the body and communicating with said cavity within said body. Moreover, the penetrating body can suitably comprise gas distributing means having two or more recesses extending substantially parallel in the direction of movement of the body.

The invention also relates to a plough assembly including a plough having a penetrating body as described above. The plough assembly further comprises cable or pipe guiding means arranged at the trailing side of the plough, and may further include means for discharging a flow of pressurized gas in a direction opposite to and/or perpendicular to the direction of moving the assembly so as to counteract collapse of the furrow formed by the plough and/or to reduce vacuum build up behind the plough assembly.

The plough assembly may further comprise means for supplying a particulate material into the furrow and into contact with the cable, drain tube or pipe laid down therein. The particulate material may be a material which is able to prevent penetration of sediments, soil, sand or other ground material into the embedded material or to prevent an undesired effect of sediments, soil, sand or other ground material on the embedded material; in those cases where the embedded material is a drain tube it is important to ensure that a substantial free flow of aqueous medium or water can take place into the drain tube and through the drain tube without significant obstruction caused by e.g. sediments. The embedded particulate material is in contact with the embedded material (e.g. a drain tube or drain tube embedded together with a textile-like material) e.g. partially or substantially surrounding the outer surface of the embedded material.

The particulate material may also be applied as an alternative and/or supplement to the textile-like material.

High-pressure gas may additionally be directed as a flow having a component directed substantially opposite to the direction of penetration of the body so as to maintain the void or cavity formed by the penetration of the body through the ground material.

BRIEF DESCRIPTION OF THE DRAWINGS

The invention is now further described with reference to the drawings wherein.

DETAILED DESCRIPTION OF PREFERRED EMBODIMENTS

Figure 1:
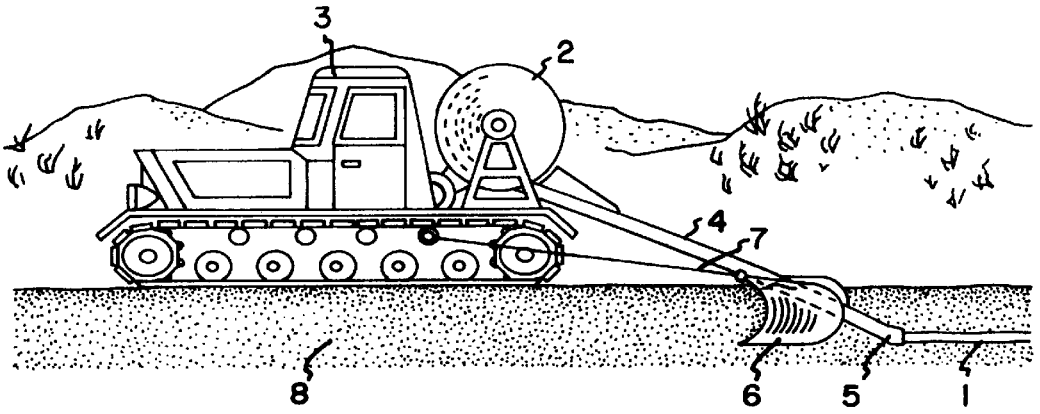
FIG. 1 illustrates how a flexible drain tube may be placed in the ground of a beach area by means of a plough body which may be used in connection with the present invention.

FIG. 1 diagrammatically illustrates a method of embedding a drain tube or pipe 1 in the ground along a coast line. As shown in FIG. 1, the drain tube 1 is coiled up on a reel 2 which is rotatably mounted on the rear end of a tractor 3 providing the driving force for penetration of the ground 8. The drain tube 1 is passed from the reel 2 through a guide tube 4 and is moved out from the guide tube 4 through a backwardly curved lower end portion 5 thereof. This end portion 5 is mounted on a plough body 6 which comprises a cutting member. A plough blade having a leading edge is employed as a cutting member in FIG. 1. The plough body 6 and the plough blade form a furrow for receiving the drain tube 1 in the ground 8. The furrow collapses around the drain tube 1 laid down therein. The plough body 6 comprising the plough blade or another cutting member is suspended by means of the guide tube 4 and a pair of wires 7 (only one is shown in the drawing) so as to be vertically movable to a desired depth. More than one drain tube 1 may be embedded at a time and more than one plough body 6 comprising a cutting member may be fitted to the rear end of the tractor 3 and may be employed for embedding drain tubes.

If the plough body shown in FIG. 1 is used in a method according to the invention, the plough body has a leading edge and an inclined ground contacting surface extending upwardly therefrom (not shown) and means for discharging at least one flow high-pressure gas (not shown) from the plough body to the inclined surface. The inclined ground contacting surface is not shown in FIG. 1.

Figure 2:
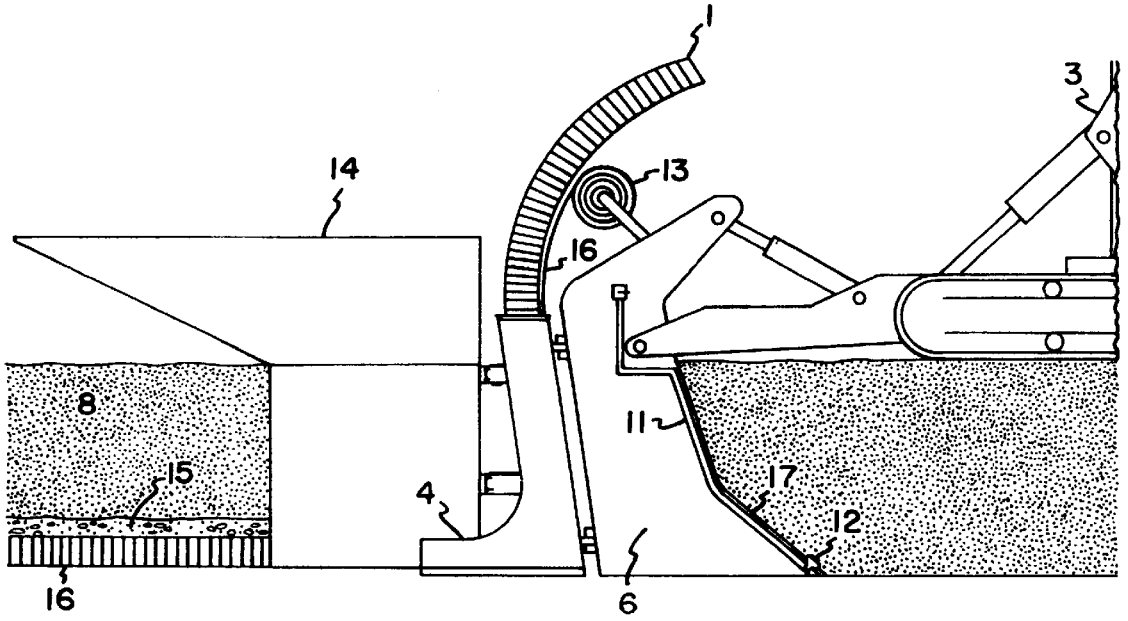
FIG. 2 shows diagrammatically and on an enlarged scale a plough assembly and a body for penetrating into a ground material. The assembly and/or the penetrating body may be used in a method according to the invention for placing a material in the ground.

FIG. 2 shows diagrammatically and on an enlarged scale a plough assembly and a body for penetrating into a ground material. The assembly and/or the penetrating body may be used in a method according to the invention for placing a material in the ground. The material may be a coiled or reeled material such as pipes, drain tubes, cables or the like. FIG. 2 illustrates the embedding of a drain tube 1 in a ground material.

The penetrating body in FIG. 2 is a plough body 6 comprising a plough blade 17 having a leading edge and an inclined ground contacting surface extending upwardly therefrom and means for discharging at least one flow of high-pressure gas from the plough body to the inclined surface.

Figure 3:
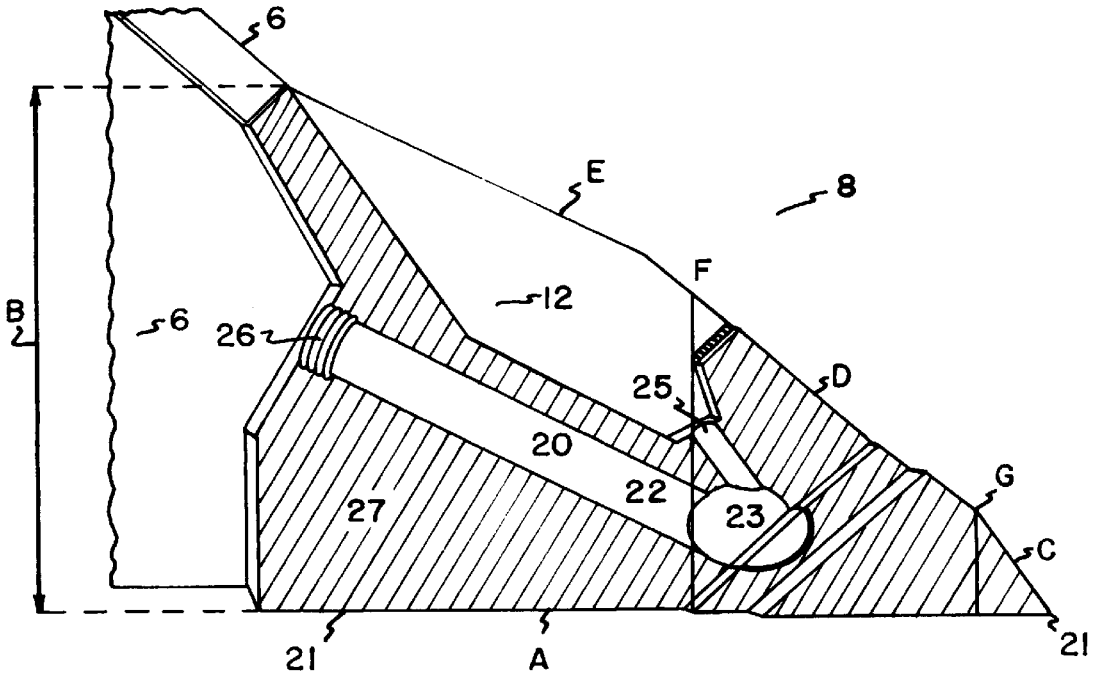
FIG. 3 is a sectional view of a part of a penetrating body having a leading edge and an inclined ground contacting surface for use in a method according to the invention.

The flow of high-pressure gas from a source of compressed gas (not shown) is directed through the high-pressure pipe or pipes 11 trough nozzles (not shown) to an air well 12 wherefrom the discharge of the flow of high-pressure gas takes place. The air well 12 is positioned on the plough blade 17 at the inclined ground contacting surface. In the embodiment shown in FIG. 2, the discharge of gas takes place at the base of the plough body 6, but the outlets of gas could be positioned at any site of the inclined ground contacting surface (see FIG. 3 showing on an enlarged scale the inclined ground contacting surface of an embodiment of a penetrating body). The opening of the air well 12 is shown facing the direction of penetration.

The driving force is exerted by means of a tractor 3, which may be a full track tractor, pulling the plough body 6 through the ground 8 so that the plough body 6 penetrates the ground 8 and forms a furrow for receiving of the drain tube 1. The plough assembly according to the invention comprises a plough body 6 and cable, drain tube or pipe guiding means arranged at the trailing side of the plough body 6. In FIG. 2, the drain tube guiding means is a guide tube 4. The drain tube 1 is passed through a guide tube 4 in the shown embodiment together with a layer of textile-like material 16, which is fed from a reel 13. The use of a textile-like material 16 is not mandatory, but may advantageously be used in those cases where penetration of sediments from the bottom side of the embedded material is likely to occur. The textile-like material 16 may be a geotextile or the like. Preferably, the textile-like material 16, if necessary, is placed just below the embedded material.

A layer of particulate material may be placed in the furrow wherein the embedded material is or has been laid down. The particulate material is a material which is able to prevent penetration of sediments, soil, sand or other ground material into the embedded material or to prevent an undesired effect of sediments, soil, sand or other ground material on the embedded material; in those cases where the embedded material is a drain tube it is important to ensure that a substantial free flow of aqueous medium or water can take place into the drain tube and through the drain tube without significant obstruction caused by e.g. sediments. The embedded particulate material is in contact with the embedded material (e.g. a drain tube or drain tube embedded together with a textile-like material) e.g. partially or substantially surrounding the outer surface of the embedded material.

The particulate material may also be applied as an alternative and/or supplement to the textile-like material.

The plough assembly shown in FIG. 2 is provided with means for supplying a particulate material into the furrow. The particulate material is sand such as filter sand.

The filter sand 15 is discharged from a filter sand container 14 mounted at the rear end (trailing side) of the plough body 6. In this case the filter sand 15 is discharged around the drain tube 1 laid down in the furrow (not shown) on top of the layer of textile-like material 16. The filter sand container 14 is provided with a funnel through which the filter sand 15 flows to an outlet and into the ground. The funnel may have a width substantially corresponding to the width of the penetrating body. In any case, it should be wide enough to be able to deliver the necessary amount of filter sand in contact with the drain tube laid down into the furrow.

FIG. 3 is a sectional view of a part of a penetrating body having a leading edge and an inclined ground contacting surface for use in a method according to the invention. The penetrating body may be the one shown in FIG. 2.

The inclined ground contacting surface is continuous, but may be divided into one or more linear or curved sections each or at least one thereof extending upwardly from the leading edge. The linear sections are also denoted cutting planes. The linear section(s) of inclined ground contacting surfaces is/are formed in manner suitable for the intended application. The number of linear sections may vary according to the properties of the ground material and is normally in a range of 1 to 6, such as 1, 2, 3, 4, 5 or 6.

The angles between the lower plane extending from the leading edge and each of the linear sections may also vary depending on the properties of the ground material and the intended flow direction of discharged gas. The angles may be in the interval between 0–180°, such as in the interval of from 0 to 90°, such as e.g. 20, 30, 40, 45, 50, 55, 60, 65, 70, 75, 80°.

The length of each of the linear sections may also vary depending on the intended application and the number of linear sections. If the penetrating body is a plough body the dimensions of the linear sections are in the range of what is normally accepted. The same applies for other penetrating bodies.

In FIG. 3 C, D and E constitute the inclined ground contacting surface and 21 the leading edge. The total length of the inclined ground contacting surface is normally from between about 50 mm to about 1000 mm. The penetrating body 6 comprises a plough blade and a body 27 as a cutting member which may both be exchangeable. The cutting member and penetrating body are made from a suitable metal such as hard steel, hard metal alloy, or the like. Suitable metals also comprise titanium and the like.

The body 27 has at least one air duct opening 26 which is connected to high-pressure pipes (not shown), and through which the high-pressure gas is supplied to an air duct 20. The air duct 20 is communicating with an air distributor 23, which in this case is a circular chamber communicating with at least one nozzle 22. The air duct, the air distributor and the nozzle may have various appearances all of which being within the scope of the invention.

The high-pressure gas flows via the air duct 20 to the air distributor 23 further to the nozzle 22 which is positioned at the base of an air well 12. The nozzle 22 has a nozzle outlet 25 positioned in the air well 12. The nozzle outlet 25 is preferably positioned in air well 12 in such a manner that the outlet does not become directly exposed to the ground material. The air well 12 may therefore have a void for a suitable positioning of the nozzle outlet. The air well 12 is a recess, which in this case is found in the inclined ground contacting surface as a groove or channel like form.

At least a part of the high-pressure gas is discharged at a location of the ground contacting surface spaced from the leading edge of the body such that the cross-sectional area of the body at said location is substantially larger than the cross-sectional area closely adjacent to the leading edge. Thus, the cross-sectional area of the plane indicated at F is larger than the cross-sectional area of the plane indicated at G.

The nozzle outlet 25 is partly encased by the air well 12 so as to protect the nozzle 22 and the nozzle outlet 25 from blockage and to allow free passage of the discharged high-pressure gas when the plough body 6 and the body 27 penetrate the ground 8.

The air well 12 is a channel or a groove which distributes the high-pressure gas into a zone of the ground 8 which is relatively compacted due the penetration of the cutting member through the ground 8; a compaction which is mainly occurring in the zone from the leading edge 21 to the air well 12. The high-pressure gas discharged from the air well 12 reduces the density of the ground material and thus reduces the resistance of friction of the compacted ground and facilitates the driving of the plough body 6 and the body 27 through the ground 8.

In the embodiment shown in FIG. 3, the body 27 has a length of about 270 mm at the base indicated as A and a height of about 200 mm at the line indicated as B.

Moreover, in the embodiment shown in FIG. 3, the body 27 comprises three linear sections or frontal cutting planes, designated C, D and E which constitute the inclined ground contacting surface, and each cutting plane is set at a different angle as defined above.

At the front end of the body 27, and seen from the direction of penetration, the angle between the plane designated C (illustrating cutting plane C of the body 27) and the base designated A is about 60° in the embodiment shown in FIG. 3.

Also in the embodiment shown in FIG. 3, the angle between the plane designated D (illustrating the cutting plane D of the body 27) and the base designated A is about 45°, and the angle between the line designated E (illustrating cutting plane E of the body 27) and the base designated A is about 30°.

In the embodiment shown in FIG. 3, the air duct 20 has a diameter of about 22 mm and is angled about 30° towards the base A, and a length of the air duct 20 of about 132 mm measured from the opening 26 to the perimeter of the air distributor 23.

In the embodiment shown in FIG. 3, the nozzle 22 has a diameter of about 9 mm and is angled about 60° against the base A resulting in a nozzle 22 length of about 32 mm when measured from the perimeter of the air distributor 23 to the nozzle outlet 25.

The air well 12 has the form of a substantially open channel or groove in the body 27. At least part of the opening of the air well 12 following the cutting planes C and D substantially faces the direction of penetration. The design of the air well 12 may be of any kind provided that it allows discharging of a flow of high-pressure gas into the surrounding ground 8 just behind the leading or cutting edge 21 of the body 27, and the design of the air well 12 furthermore protects the nozzle 22 and the nozzle outlet 25 from blockage of soil, sand or other particles in the ground.

It should be understood that other dimensions and shapes of the plough member as well as individual parts and features of the plough member may be used without departing from the spirit and scope of the invention.

As an example, the body 27 may have a width of up to about 500 to 600 mm, and the nozzles 22 may be exchangeable. The body 27 may also be provided with nozzles with outlets for discharging high-pressure gas in the opposite direction of penetration so as to maintain the furrow created by the plough body 6 open.

Further modifications of the body 27 such as e.g. implementation of exchangeable cutting planes or surfaces are also possible without departing from the spirit and scope of the invention.

Figure 4:
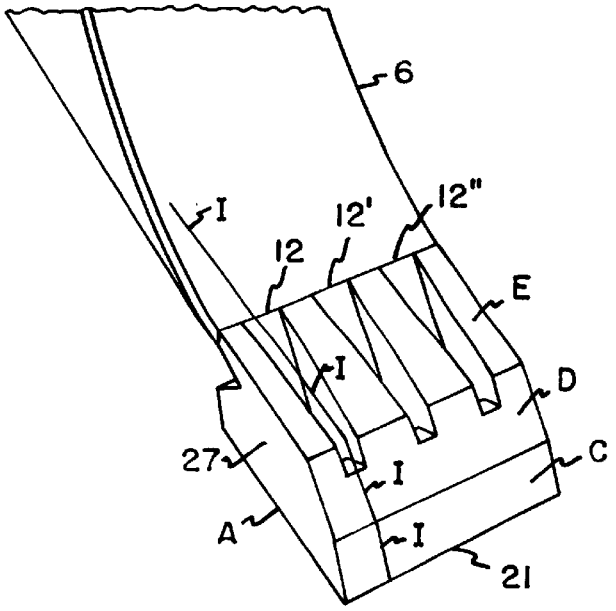
FIG. 4 is a perspective view of a penetrating body fitted to the plough body as shown in FIG. 3.

FIG. 4 is a perspective view of a body fitted to the plough body as shown in FIG. 3.

FIG. 4 perspectively illustrates the body 27 shown in FIG. 3 fitted to a plough body 6. The body 27 is provided with three air wells 12, 12' and 12" constituting three recesses extending substantially parallel in the direction of movement of penetration. In the air well 12, suitably at the base of each air well 12, a nozzle (not shown) and a nozzle outlet (not shown) are contained wherefrom the flow of high-pressure gas is discharged.

The line I illustrates the line along which the body 27 split for the sectional illustration given in FIG. 3.

In the embodiment shown in FIG. 4, the dimension of the plane designated C is about 46 mm by 250 mm, the dimension of the plane designated D is about 146 mm by 250 mm, and the dimension of the plane designated E is about 135 mm by 250 mm. The dimensions are given for illustrative purposes only and each of the planes C, D and E may vary in dimension and angle depending of the shape of the body 27 and the intended application.

Figure 5:
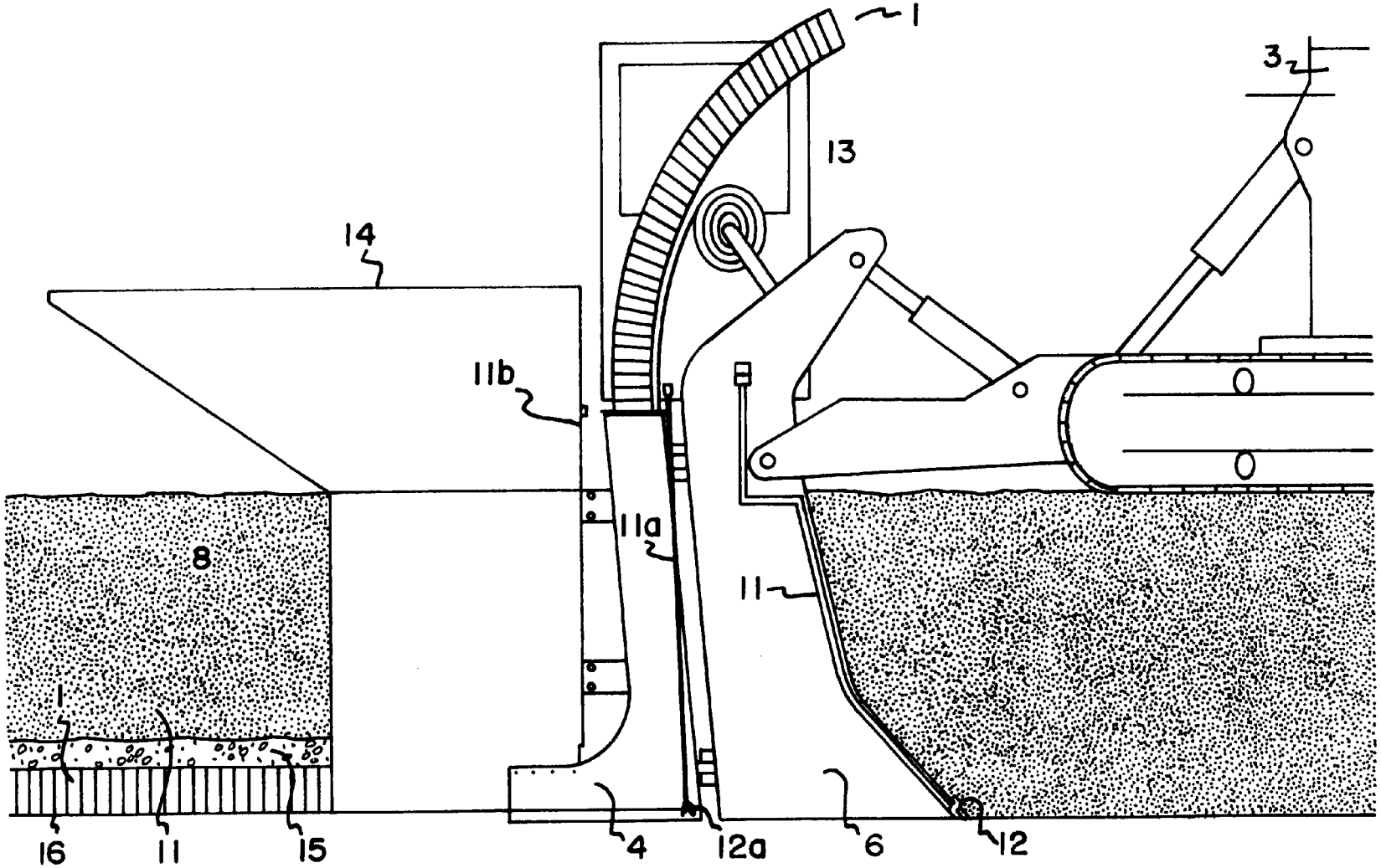
FIG. 5 diagrammatically shows a plough assembly according to the invention fitted with means for discharge of a gas at a guide tube arrangement and at a filter sand container arrangement.

FIG. 5 diagrammatically shows another plough assembly according to the invention fitted with means for discharge of a gas at a guide tube arrangement. Furthermore, the plough assembly is fitted with means for discharge of a gas at a filter sand container arrangement.

The penetrating body in this embodiment is also illustrated as a plough body 6 (cf. FIG. 2) comprising a plough blade for embedding drain tubes, cables or pipes. Furthermore, the plough body comprises a leading edge and an inclined ground contacting surface and means for discharge of high-pressure gas to the inclined surface so as to facilitate the penetration of the body. The design of the inclined ground contacting surface may be similar to the one shown in FIGS. 3 and 4.

In this embodiment, the guide tube 4 is provided with air well or wells 12*a* e.g. having similar properties as those found in the ground contacting surface (air well 12) in the body designated 27 in FIGS. 3 and 4. The nozzles (not shown) in the air wells 12*a* are fed with high-pressure gas via one or more high-pressure pipe/pipes 11*a*. The discharge of gas and the design of the air duct, nozzles and air wells may be of any kind provided that it provides a flow of gas which enables upkeep of the furrow which is established by the plough body 6 for a suitable period of time which is required for embedding of e.g. a drain tube. Thus, the gas may be high-pressure gas, compressed gas or pressurized gas, and the gas may be atmospheric air or the like.

When discharging high-pressure gas from the air wells 12*a,* the furrow established by the plough body 6 will remain unobstructed for an extended period of time ensuring an even more efficient embedding of the drain tube 1. The direction of the flow of the high-pressure gas discharged from the air wells 12*a* is substantially opposite to and/or substantially perpendicular to the direction of moving the plough assembly so as to counteract collapse of the furrow formed by the plough and/or to reduce vacuum build up behind the plough assembly.

As discussed in connection with FIG. 2, the plough assembly may also comprise means for supplying a particulate material into the furrow and in contact with the drain tube, cable or pipe laid down therein. In FIG. 5 the plough assembly is equipped with such means in the form of a container 14 from where sand is provided to the furrow. As shown in FIG. 5 (but not mandatory), the filter and container 14 may be equipped with one or more pipes 11*b* such as, e.g., high-pressure pipes through which air is fed to nozzles (not shown). The nozzles (not shown) will allow discharge of gas such as high-pressure gas, pressurized or compressed gas into the filter sand container allowing an improved flow of filter sand 15 into the furrow and around the drain tube 1 laid down therein. The gas outlet may be in an air well like the one described in connection with FIG. 3.

Other embodiments than those shown in FIGS. 1–5 are of course within the scope of the invention. Thus, a plough assembly comprising the plough body shown in FIG. 2 together with drain tube, cable or pipe guiding means arranged at the trailing side of the plough and means for discharging a flow of pressurized gas as shown in FIG. 5 (with or without means for supplying a textile-like material and with or without means for supplying a particulate material) is of course also within the scope of the invention.

Figure 6:
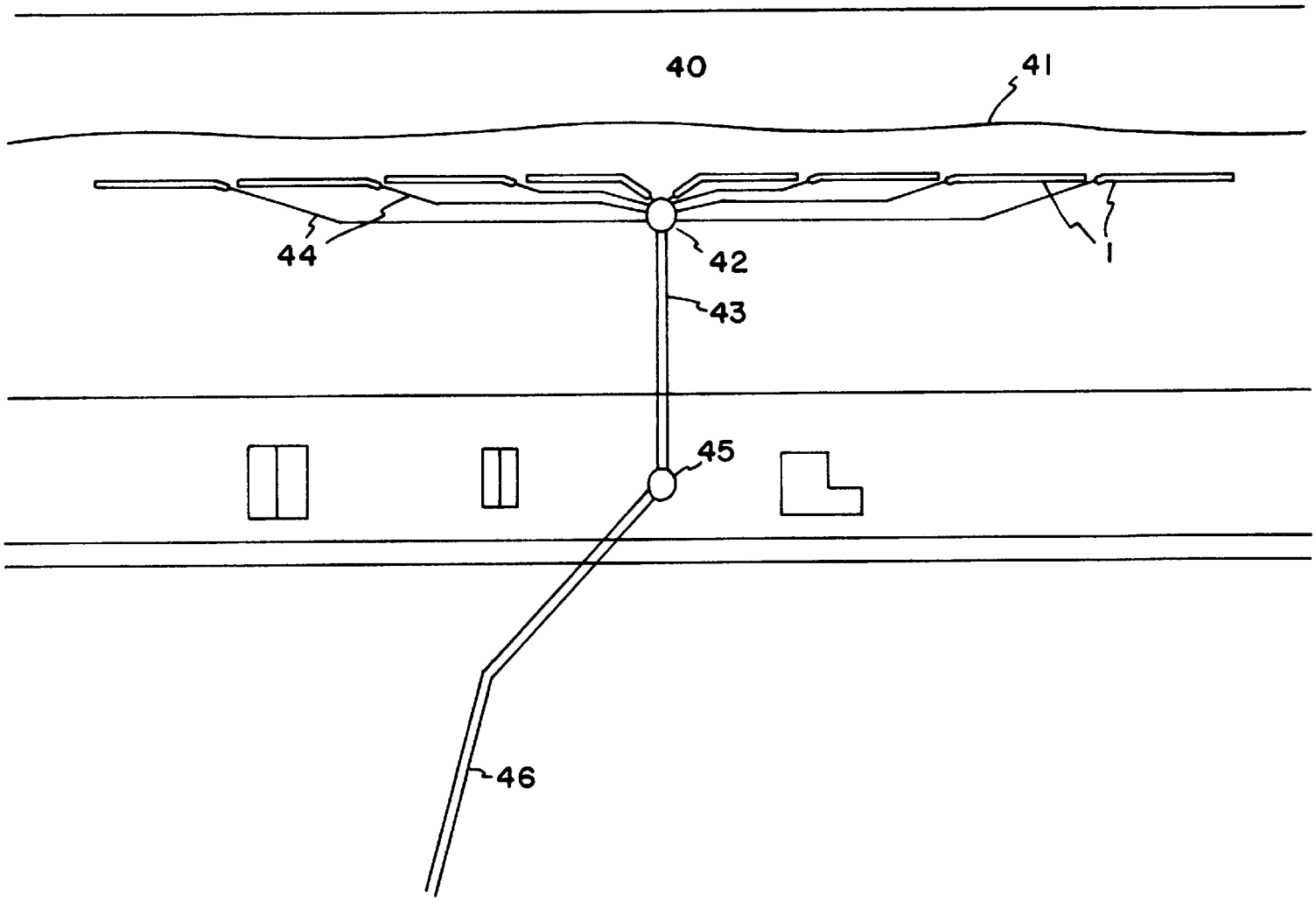
FIG. 6 diagrammatically depicts the layout of an embedded costal drain system obtained by the employment of the method according to the invention.

FIG. 6 diagrammatically depicts the layout of an embedded costal drain system obtained by the employment of the method according to the invention.

FIG. 6 depicts the configuration of the site conditions of a costal area for the embedding of drain tubes and for prevention of the erosion of the coast line 41. The location is typically a sandy beach resort area.

The sea 40 is eroding the sandy coast line 41. Plural sections of drain tubes 1 are shown embedded in the coast line 41. The drain tubes 1 are connected to conveying pipes 44 each of which being connected to a collecting pipe 43 via the collector well 42. The collecting pipes 43 extend from a pumping station 45 which via the discharge pipe 46 leads water pumped away from the coast line 41 to waste in the inland ground.

It should be understood that various changes and modifications of the method, the body for penetrating and the plough assembly described above may be made within the scope of the present invention.

For example, the method for the penetration using a plough as a penetrating body may also be performed when embedding e.g. cables in the seafloor or in any base of a body of water.

EXAMPLE 1

The efficiency of the method according to the invention can be demonstrated by the following example. The equipment employed is schematically shown in FIG. 2.

A flexible drain tube as seen in FIGS. 1 and 2 having a diameter of 126 mm was embedded using a plough as illustrated in FIG. 2 in a beach area in a depth of about 2.2 m below the beach surface and below the ground water level. The ground water level in the ground was at the upper surface of the ground. The method employed made use of a plough body having a penetrating body with a leading edge and an inclined ground contacting surface extending upwardly therefrom as illustrated in FIG. 3.

The penetrating speed obtained with a plough provided with means for discharging a high-pressure gas flow to the inclined surface of the penetrating body was about 4 m/min which was possible by having a supply rate of flow of high-pressure gas discharged through air wells and nozzles as illustrated in FIGS. 3 and 4 of about 12 $m^3$/min and a supply pressure of from about 10 to about 12 bar.

The driving force supplied to the plough as seen in FIG. 2 was from a conventional full track tractor as seen in FIG. 1 and which is normally used when embedding cables above the ground water level in depths not exceeding about 150 cm.

The method and equipment employed ensured a successful embedding of drain tubes at the desired depth. The velocity and depths achieved with the method and equipment according to the invention was significantly improved over the normally experienced by the use of known methods and equipment.

EXAMPLE 2

Embedding of costal drain tubes by use of a method and equipment according to the invention In order to cause sedimentation of sedimentary solid material transported in a body of water is of importance when securing In order to secure e.g. costal lines from excessive erosion during storm it is possible to cause sedimentation of sedimentary solid material transported in a body of water by embedding of costal drain tubes. A costal drain concept is disclosed in e.g. EP patent No. 0 108 269 B1.

A) Comparative tests at Enø Strand

A costal drain was established at Enø Strand, a sandy beach resort area located on the downdrift side on an inlet harbour, Karrebaeksminde, at the south-west cost of the island Zealand in Denmark, and approximately 600 m of costal drain had to be embedded at this location. The sandy beach area has a ground material with pores at least partially filled with water.

The drain tubes used for the drain system were made of flexible corrugated PVC having an outer diameter of 113 mm. The laying depth was fixed to 2 m below the water level and a layer of minimum 40 mm coarse filter sand were placed around or in contact with the drain tube.

The location at Enø Strand is equivalent to the costal area diagrammatically depicted in FIG. 6.

i) Use of a trenching machine at Enø Strand

A 26 t trenching machine having a penetrating body without any means for discharging high-pressure gas. A hydraulic tilting chain sword was fitted as a penetrating body capable of reaching the required depth and forming a furrow having the necessary width to fit the receival of the drain tube, and this equipment was used in the test.

However, the use of the trenching machine equipped with the penetrating body mentioned above was unsuccessful, since the sand from below the water level and rocks in the ground obstructed the operation of the penetrating body, especially driving of the chain itself.

Moreover, a correct placement of filter sand which was judged necessary at that location, around the drain tubes could not be ensured, due to a poor formation of the furrow for receiving the drain tubes. Even if it was judged possible to modify the trenching machine for an improved embedding of the drain tubes such as employing means according the invention, all further tests and modifications of the trenching machine were abandoned due to the expected costs.

ii) Use of a plough body at Enø Strand

Based on the above results, a self-propelled plough body (as e.g. schematically shown in FIG. 1) was used to carry out the embedding of drain tubes in the sandy beach area.

The plough body was equipped with a filter sand container and guiding systems for feeding of a drain tube and a textile-like material, respectively. However, the plough body was not according to the invention since no means for the discharge of gas, such as high-pressure gas, was included. The penetrating body was in the form of a plough blade having a leading edge. The width of the penetrating body was about 220 mm which corresponded approximately to the width of a funnel of the filter sand container measured at the outlet of the filter sand.

The plough was provided with a guiding system for placement of a textile-like material which was a geotextile just below the drain tube in order to avoid the penetration of sediments from the bottom side in case the drain tube was insufficiently covered by the layer of filter sand.

A tractor having a gross weight of 22 t and around 300 HP (approx. 220 kW) was used to pull the plough body through the ground material. However, the power applied was insufficient to pull the plough body and to establish the embedding of the drain tubes at the desired depth of 2 m.

By applying further power by using the additional pulling force provided by a 220 HP (approx. 161 kW) trenching machine and a 300 HP (approx. 220 kw) tractor it was possible to penetrate the plough body to the desired depth and advancing the combined assembly at a velocity of approximately 0.8 m per minute. Thus, the total pulling force applied was around 820 HP (approx. 602 kW).

However, it was very difficult to coordinate the pulling forces of the three tractors and the achievement of a straight line embedment was found to be equally difficult.

Data for the grain size distribution of the ground material (sand) were provided and showed that 50 percent by weight of the sand at Enø Strand at a depth of 1.5 m had a grain size of 0.339 mm and at a depth of 2.5 m had a grain size of 0.3884 mm. Grain sizes varied from approx. 0.065 mm to approx. 4 mm.

Conclusively, it has proved impossible or at least very difficult and inappropriate to achieve a proper embedding of drain tubes in a costal drain system by the use of conventional methods and equipment.

B) Tests at Oksbøl Strand by use of a method and equipment according to the invention Based on the results achieved at Enø Strand, a method and equipment according to the invention was employed for embedding a costal drain system at Oksbøl Strand. Oksbøl Strand is a sandy beach resort area like the one at Enø Strand (cf. FIG. 6).

The equipment employed for the embedding of drain tubes at Oksbøl Strand is schematically illustrated in FIG. 2 and the penetrating body and plough assembly was in accordance with the invention. The penetrating body employed was like the one illustrated in FIGS. 3 and 4.

Data for the grain size distribution of the ground material (sand) were provided and showed that 50 percent by weight of the sand at Oksbøl Strand at a depth of 1.0 m had a grain size of 0.201 mm and at a depth of 1.6 m had a grain size of 0.1997 mm. Grain sizes varied from approx. 0.065 mm to approx. 2 mm.

Thus, the sand at Oksbøl Strand was considerably finer than the sand at Enø Strand, which usually corresponds to a more dense and tightly packed sand being even more difficult to penetrate and to embed and maintain drain tubes therein.

The tractor used as driving force had a gross weight of 22 t and delivered approx. 300 HP (approx. 220 kW). The tractor had 2 caterpillar tracks, each approx. 0.76 m wide and 5.60 m long.

A plough body with a plough blade as illustrated in FIGS. 3 and 4 was used as a penetrating body. It had a width of 320 mm which forms a furrow considered suitable for embedding of 160 mm drain tubes.

The inclined ground contacting surface extending from the leading edge of the penetrating body was provided with three grooved recesses serving as air wells each provided with two nozzles having a diameter of approx. 8.5 mm. A source of high-pressure gas (Atlas Copco compressor type XA 175 Dd) was connected to high-pressure pipes communicating with the air wells and nozzles located in the inclined ground contacting surface of the penetrating body.

The working pressure of the compressor was about 7 bar and the compressor delivered about 10.4 $m^3$ of compressed air per minute. The power necessary for generating this volume and pressure of compressed air was about 110 HP (approx. 80 kW).

A total of five tests were performed using the method and equipment according to the invention, and the results are shown in the table below.

TABLE 1

Embedding of 160 mm ϕ drain tubes using the method and equipment according to the invention

| Test No. | Depth of penetration | Depth below the water level | Air escape through air wells 1–3 ($m^3$/m) | Air pressure (bar) | Velocity of penetration (m/min) |
|---|---|---|---|---|---|
| 1 | 0.0 | 0.0 | 9.5 | 7.0 | 0.0 |
| 2a | 2.0 | 1.8 | 0.0 | 0.0 | 0.0 |
| 2b | 2.0 | 1.8 | 6–8 | 7.4 | 4.0 |
| 3 | 2.0 | 2.3 | 6–8 | 7.4 | 4.5 |
| 4 | 2.0 | 2.0 | 6–8 | 7.4 | 4.5 |
| 5 | 1.0 | 1.0 | 7–8 | 7.0 | 5.5 |

The results shown in table 1 above clearly show that the driving force applied was insufficient to advance the plough assembly with the penetrating body without the discharge of compressed air through the air wells (results given in test 2a).

However, when supplying compressed air to the air wells in the penetrating body, the plough assembly advanced even if the driving force was running at only about half its capacity and, thus, at a power consumption level considerably lower than that applied to the penetrating body used in the tests at Enø Strand described above.

When applying full driving force to the assembly, the caterpillar tracks moved slightly faster than the penetration velocity of the plough assembly, indicating that the available driving force was more than sufficient to obtain the high velocity of penetration.

The driving force required to bring the velocity of penetration to around 4 m/min at the tests at Oksbøl Strand was estimated to be approx. 150 HP (approx. 110 kW). Thus, the total power consumption (driving force and power used for generating compressed air) was approx. 260 HP (approx. 191 kW).

Based on the above tests 1–5, it is estimated that the use of the method and equipment according to the invention will lower the required pulling force by a factor of at least 4 compared to the power used in the method described under the heading A.

Based on the reduced power consumption and increased velocity of penetration on application of the method and equipment according to the invention, it is estimated that the energy consumption is reduced with a factor of at least 10 compared to the energy consumed in the method described under the heading A (calculation based on power consumption x time consumption).

The drain tubes were embedded in a straight line and the layer of filter sand was fully surrounding the drain tube in a layer of 100 mm on top of the tube, 50 mm at the side of the tube and 50 mm below the geotextile.

Conclusively, the method and equipment according to the invention have proven that embedding of drain tubes for a costal drain system can be performed with success in an economically, environmentally friendly and improved manner.

I claim:

1. A method for use of a penetrating body having a leading edge and an inclined ground contacting surface extending upwardly therefrom, into a porous ground material with pores being at least partially filled with water, said method comprising the steps of applying a driving force to said penetrating body in the direction of penetration, and discharging from said penetrating body at least one flow of gas to said inclined surface so as to facilitate the penetration of the body, the gas having a pressure adapted to exceed the pressure of the surrounding environment.

2. The method according to claim 1, wherein the penetrating body comprises a plough blade for embedding elongated members selected from the group consisting of drain tubes, cables and pipes.

3. The method according to claim 1, wherein the ground material comprises at least one of the substances, soil, sand, peat, clay, rock, seafloor, seabed and ground fill.

4. The method according to claim 1, wherein high-pressure gas is supplied to at least one recess formed in the inclined ground contacting surface.

5. The method according to claim 1, wherein at least part of the gas is discharged at a location of the inclined ground contacting surface spaced from the leading edge of the body such that the cross-sectional area of the body at said location is substantially larger than the cross-sectional area closely adjacent to the leading edge.

6. The method according to claim 1, wherein the driving force is a percussive force.

7. The method according to claim 1, wherein the driving force is an oscillating force.

8. The method according to claim 1, wherein the pressure of the gas being discharged is in a range from 1 to 100 bar.

9. The method according to claim 8, wherein the pressure of the gas being discharged is in a range from 5 to 50 bar.

10. The method according to claim 9, wherein the pressure of the gas being discharged is in a range from 5 to 20 bar.

11. The method according to claim 1, wherein the flow of high-pressure gas discharged is pulsating.

12. The method according to claim 11, wherein the flow of high-pressure gas discharged in a pre-determined sequence of varying pulses.

13. The method according to claim 1, wherein the pressure of the gas is varying.

14. A body for penetrating into a porous ground material and comprising a leading edge and an inclined ground contacting surface extending upwardly therefrom, means for receiving a driving force so as to cause the penetration, means for supplying a pressurized gas to a cavity defined within the body, and gas discharging means communicating with the cavity for discharging the pressurized gas to at least one opening defined in the ground contacting surface and into the ground material surrounding the body so as to facilitate the penetration.

15. The body according to claim 14, wherein the gas discharging means comprises means for distributing the gas over a substantial part of an outer side of the inclined ground contacting surface of the body.

16. The body according to claim 15, wherein the gas distributing means comprises at least one recess defined in the outer side of the ground contacting surface of the body and communicating with said cavity within said body.

17. The body according to claim 16, comprising at least two recesses extending substantially parallel in the direction of movement of the body.

18. A plough assembly including a plough having a penetrating body according to claim 14, further comprising guiding means arranged at the trailing side of the plough for guiding an elongated body to be embedded in the ground material.

19. The plough assembly according to claim 18, further comprising means for discharging a flow of pressurized gas in a direction substantially opposite to the direction of moving the assembly so as to counteract collapse of a furrow formed by the plough.

20. The plough assembly according to claim 19, further comprising means for supplying a particulate material into the furrow and into contact with the elongated body being laid down therein.

* * * * *